United States Patent [19]

Parrish

[11] Patent Number: 4,767,895

[45] Date of Patent: Aug. 30, 1988

[54] REMOVABLE KEY OFF-LOCK SWITCH HAVING IMPROVED LOCKING ACTUATOR

[75] Inventor: Timothy L. Parrish, Kenly, N.C.

[73] Assignee: Eaton Corporation, Cleveland, Ohio

[21] Appl. No.: 114,325

[22] Filed: Oct. 27, 1987

[51] Int. Cl.[4] ..... H01H 27/00

[52] U.S. Cl. ..... 200/43.04; 200/339

[58] Field of Search ..... 200/43.04, 43.01, 43.16, 200/339, 334

[56] References Cited

U.S. PATENT DOCUMENTS

| | | | |
|---|---|---|---|
| Re. 30,273 | 5/1980 | Grebner et al. | 200/43.04 |
| 3,632,914 | 1/1972 | Osika | 200/43.01 |
| 3,678,229 | 7/1972 | Osika | 200/43.01 |
| 3,906,176 | 9/1975 | Carlson | 200/43.04 |
| 4,168,416 | 9/1979 | Josemans | 200/43.04 |
| 4,174,472 | 11/1979 | Josemans | 200/43.04 |
| 4,230,917 | 10/1980 | Osika | 200/43.01 |
| 4,291,207 | 9/1981 | Reinke et al. | 200/43.04 |
| 4,345,121 | 8/1982 | Tenner | 200/43.04 |
| 4,440,994 | 4/1984 | Nat | 200/43.04 |

*Primary Examiner*—Renee S. Luebke

*Attorney, Agent, or Firm*—L. G. Vande Zande

[57] ABSTRACT

An actuator pivotally mounted within a switch housing has cantilevered side members positioned in blocking alignment with projections on interior side surfaces of the housing to prevent movement of the actuator from an OFF position to an ON position. A removable operator has depending key portions which deflect the cantilevered side members inwardly to clear the projections when the operator is assembled to the actuator. The cantilevered side members engage inner surfaces of the projections when the operator is removed with the actuator in the ON position, permitting movement to the OFF position wherein the cantilevered side members return to the blocking position. A compression spring may be disposed between distal ends of the cantilevered side members to provide additional outward bias to the side members.

16 Claims, 3 Drawing Sheets

REMOVABLE KEY OFF-LOCK SWITCH HAVING IMPROVED LOCKING ACTUATOR

BACKGROUND OF THE INVENTION

This invention relates to pivoted actuator switches such as rocker switches or toggle lever switches. More specifically the invention relates to switches of the aforementioned type wherein the actuator comprises means operable to lock the switch in a predetermined position, most commonly an OFF position, when a separable operator member or key is removed therefrom.

Switches of the aforementioned type have been known heretofore. One such switch is disclosed and claimed in S. W. Grebner et al U.S. Pat. No. Re. 30,273 which is assigned to the assignee of this invention. The disclosure of the above identified patent is incorporated herein by reference. In the above identified patent, the operator member or key may be removed from the switch, locking the switch actuator in the OFF position or causing the actuator to become locked when subsequently moved to the OFF position. Replacement of the operator key upon the actuator releases the actuator for movement between the ON and OFF positions.

Actuator members for switches of the aforementioned type commonly comprise a pair of actuator halves, a separate latch bar and often a separate biasing member, such as a spring, subassembled prior to assembly within the switch housing. The number of discrete parts and the several steps required to fabricate the actuator assembly contributes to increased manufacturing cost, assembly errors and improper interaction between the parts which prevents the device from functioning properly.

SUMMARY OF THE INVENTION

This invention provides a pivoted actuator switch having a locking actuator operable to lock the switch in a predetermined position by removal of an operator key from the actuator. The actuator is a one-piece molded part incorporating latching elements and a biasing means for the latching elements for simplifying assembly and reducing manufacturing costs of the switch.

The invention and its advantages will be more fully understood when reading the following description and claims in conjunction with the accompanying drawings.

DESCRIPTION OF THE PREFERRED EMBODIMENTS

Figure 1:
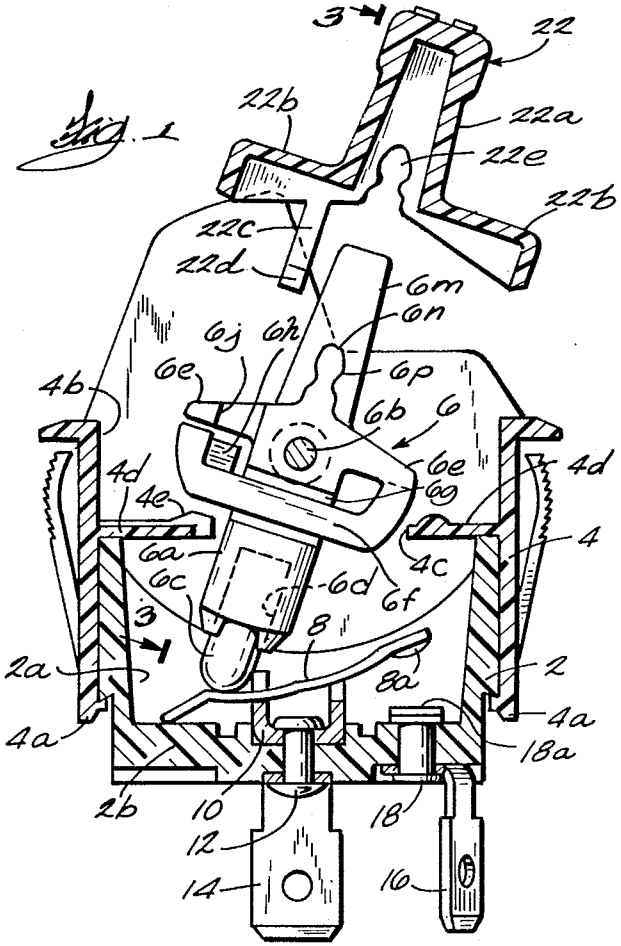
FIG. 1 is a cross sectional view of a rocker switch with an off-lock pivoted actuator showing the switch in an OFF condition and an operator key removed therefrom.

Referring to FIG. 1, there is shown a pivoted actuator off-locking switch provided with a molded insulating housing comprising a base 2 secured to a molded frame 4 by hooks **4*a* integrally molded with the frame. Frame 4 has an opening 4*b* communicating with its upper surface and with a cavity 2*a* of base 2 through a smaller opening 4*c* formed in a horizontal wall 4*d* of the frame. An actuator 6 is pivotally supported in the frame 4 within the opening 4*b* and has a lower stem 6*a* projecting downwardly into the cavity 2*a* through the opening 4*c*. Pivotal support for actuator 6 is preferably provided by trunions 6*b* (only one of which is visible in FIGS. 1 and 5) molded integrally with the actuator and extending laterally into holes (not shown) in side walls of frame 4. Stem 6*a* includes a contact actuating spring biased cylindrical plunger 6*c* disposed within a cylindrical recess 6*d* open to the bottom of stem 6*a*. The projecting end of plunger 6*c* is formed spherically and rests upon an upper surface of a movable contactor 8 which is pivotally supported on a U-shaped contact 10. An electrically conducting rivet 12 secures contact 10 to an interior surface of a lower wall 2*b* of base 2 and secures a terminal 14 to an exterior surface of lower wall 2*b*. A second terminal 16 is secured to the exterior surface of lower wall 2*b* by a rivet 18 which has a headed contact portion 18*a* disposed on the interior surface of lower wall 2*b*. Movable contactor 8 has a contact element 8*a* formed at its right-hand end for engagement with stationary contact 18*a***.

Figure 5:
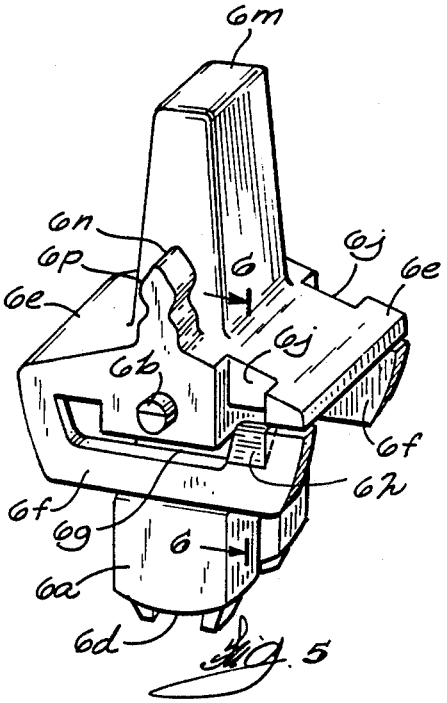
FIG. 5 is an isometric view of the one piece molded actuator and locking elements in accordance with this invention.
Figure 6:
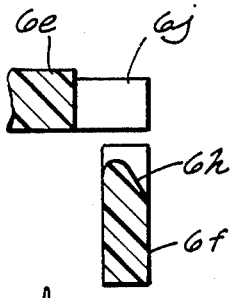
FIG. 6 is a fragmentary sectional view taken along the line 6—6 in FIG. 5 showing a cam surface formed at a distal end of a cantilevered locking element of the actuator.

In a-preferred embodiment, actuator 6 is a one piece molded member having a central platform portion **6*e* extending in opposite directions from the rotational axis for the actuator formed by trunions 6*b*. Cantilevered side members 6*f* are formed to the under side of platform 6*e* at the outer corners of one extreme end thereof, the side members 6*f* extending within relieved grooves 6*g* in lower stem 6*a* to the opposite end of platform 6*e*. The distal ends of cantilevered side members 6*f* are provided with respective oblique surfaces 6*h*. The lateral edges of platform 6*e* have grooves 6*j* formed therein in vertical alignment with oblique surfaces 6*h* to form keyway slots as will become more apparent later. Referring also to FIG. 5 an upstanding lever 6*m* is formed at the center of the main platform 6*e* to serve as a manually engageable handle for operating the actuator 6 from one position to another. Projections 6*n* extend outwardly at opposite sides of actuator lever 6*m*, the projections having an enlarged shoulder portion 6*p* near the upper end. Projections 6*n*** serve as detent retention members for an operator key member as will be described hereinafter.

Frame 4 has a pair of spaced projections 4*e* formed on the horizontal wall 4*d* at the left-hand end of opening 4*c* as viewed in FIG. 1. The projections 4*e* are located adjacent the opposite side walls defining opening 4*b*. When the actuator 6 is in the OFF position illustrated in FIG. 1, the cantilevered side members 6*f* are disposed above the projections 4*e* and in lateral alignment therewith as shown in FIG. 3 to block pivotal movement of actuator 6 in a counterclockwise direction toward the position shown in FIG. 2. Accordingly, the actuator is therefore locked in its OFF position.

Figure 4:
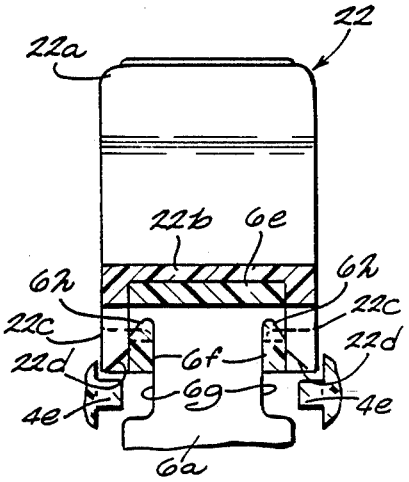
FIG. 4 is a fragmentary sectional view similar to FIG. 3 showing the operator key assembled to the actuator wherein the locking elements are deflected inwardly to clear the blocking projections in the switch housing.

An operator member 22, shown disassembled from the actuator 6 in FIG. 1, has a hollow upstanding lever portion 22*a* shaped complementally to upstanding lever portion 6*m* of actuator 6. A base portion 22*b* of operator 22 extends in opposite directions to overlie the platform portion 6*e* of actuator 6. Operator 22 has a pair of depending key portions 22*c* formed at opposite lateral sides of the base portion 22*b* at one side of the center of operator 22. The lower ends of key portions 22*c* are provided with oblique surfaces 22*d*. Operator 22 is operatively coupled to actuator 6 by sliding the operator over the upstanding lever 6*m* such that the key portions 22*c* extend within the slots 6*j* of actuator 6. The lateral walls of lever portion 22*a* are provided with slots 22*e* which are formed complementally to the projections 6*n*, thereby providing a constricted open end to the bottom of operator 22. Pressure on operator 22 in the downward direction causes the constricted opening of slot 22*e* to open sufficiently to receive the enlarged shoulder portion 6*p*, thereby firmly positioning the operator 22 upon actuator 6. This coupling movement carries oblique portions 22*d* into engagement with oblique portions 6*h* on actuator 6 to cam the distal ends of cantilevered side members 6*f* inwardly. The final position of operator 22 on actuator 6 is shown in FIG. 4 wherein the inner vertical surfaces of key portions 22*c* are in engagement with outer vertical surfaces of side members 6*f* to hold the distal ends of cantilevered side members 6*f* inwardly, clear of the alignment with projections 4*e* to thereby permit the actuator 6 to be freely moved between the ON and OFF positions.

Figure 2:
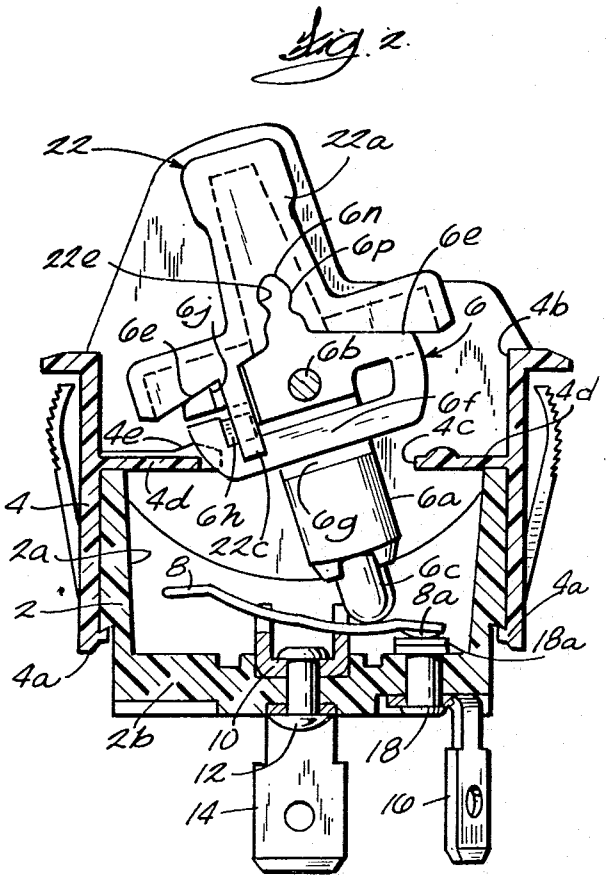
FIG. 2 is a cross sectional view similar tc FIG. 1 but showing the operator key assembled to the actuator and the switch in the ON condition.
Figure 3:
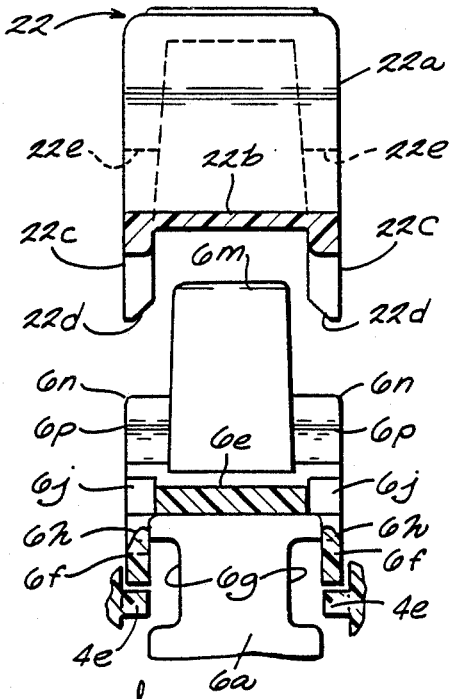
FIG. 3 is a fragmentary sectional view taken along the line 3—3 in FIG. 1 showing the operator key removed from the actuator and locking elements of the actuator aligned with projections in the switch housing for blocking movement of the actuator.

Operator key 22 may be removed when the actuator is in the ON position as shown in FIG. 2. Such removal of operator 22 permits the cantilevered side members 6*f* to move outwardly, but the outer vertical surfaces thereof engage interior surfaces of projections 4*e*. This engagement permits movement of the actuator 6 to the OFF position shown in FIG. 1, with the cantilevered side members 6*f* sliding along the interior surfaces of projections 4*e* until the lower edge of side members 6*f* move above the projections 4*e*. At that point, the cantilevered side members move apart to their original position adjacent the side walls of frame 4 in blocking alignment with the projections 4*e* to block subsequent movement of the actuator 6 to the ON position.

Figure 7:
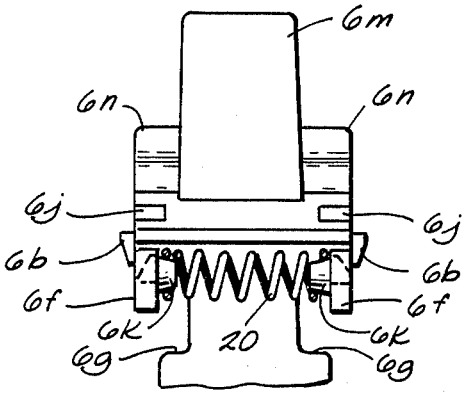
FIG. 7 is an end view of a modification of the actuator showing a backup spring assembled thereto.

In the aforedescribed embodiment, it is contemplated that the inherent resiliency in the material of actuator 6 and the design of cantilevered side members 6*f* will cause the side members 6*f* to return to their original position when operator key 22 is removed. However, to insure that cantilevered side members 6*f* do move apart and return to their original position, an alternative embodiment is shown in FIG. 7 wherein a helical spring 20 may be positioned between the side members at the distal ends thereof. The open ends of spring 20 may be positioned over cylindrical bosses 6*k* formed on the inner surfaces of side members 6*f* and the spring 20 made of sufficient length to place it under compression when so assembled, thereby to maintain the spring in the assembled position.

Figure 8:
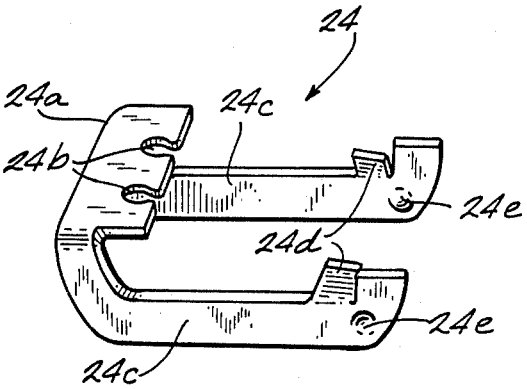
FIG. 8 is an isometric view of still another modification of the actuator showing a formed metal part which may be substituted for the integrally molded lcck̇ing elements.

Still another embodiment of the invention is shown in FIG. 8, wherein the side members 6*f* of actuator 6 may be omitted from the molded actuator member and replaced by a formed metal clip 24 made of spring steel or the like. Clip 24 has a centrally located platform 24*a* in which a pair of restricted opening slots 24*b* are formed. Side members 24*c* of similar shape to side members 6*f* are formed over at the opposite lateral sides of platform 24*a*. The distal ends of side members 24*c* have upwardly extending tabs 24*d* which are bent angularly inwardly to serve as cam surfaces for engagement by key portions 22*c* in a similar manner to surfaces 6*h* of the integrally molded side members 6*f*. The distal ends of side members 24*c* also have cylindrical projections 24*e* formed on inner surfaces thereof to provide mounting seats for the back-up spring 20. Although not specifically shown, the underside of the appropriate platform 6*e* of actuator 6 is provided with locating bosses to receive the slots 24*b* for attaching the clip 24 to the underside of actuator 6. Securement of clip 24 to actuator 6 may be a snap-fit between the bosses (not shown) and slots 24*b*, or by heat staking the projections over the clip, or ultrasonically welding the projections and clip 24. Although this modification does require a sub-assembly operation, such operation is considerably less complex than that previously described wherein two actuator halves, a latch member and spring are subassembled.

It is further contemplated that the switch of this invention may be assembled to provide a lock-on function as opposed to the lock-off function described herein. By assembling switch base 2 to frame 4 in an end-for-end rotation, 180 degrees displaced from that shown in the drawings, the lock-on function may be accomplished.

It is to be understood that the invention hereinbefore described is not intended to be confined to the particular preferred embodiment of pivotal actuator off-lock switch with one piece molded actuator as disclosed, inasmuch as it is susceptible of various modifications without departing from the scope of the appended claims.

I claim:

1. An electric switch comprising, in combination:

an insulating housing having an opening therein and a pair of spaced projections at opposite sidewalls within said opening;

switch contacts within said housing;

an actuator pivotally supported within said opening for movement between first and second positlions for actuating said switch contacts between first and second conditions, respectively, said actuator comprising locking members at opposite sides juxtaposed said sidewalls, said members being aligned with said projections when said actuator is in said second position blocking movement of said actuator to said first position;

an operator removably attached to said actuator, said operator having depending key portions camming said locking members inwardly away from said sidewalls clear of said projections permitting unrestricted movement of said actuator between said first and second positions when said operator is attached to said actuator, and wherein said locking members bear against inner surfaces of said projections for sliding movement therealong when said operator is removed from said actuator in said first position, said actuator thereafter being movable to said second position with said operator removed, and means for returning said locking members to positions juxtaposed said sidewalls and in alignment with said projections, said locking members blocking subsequent movement of said actuator to said first position while said operator is removed.

2. The electric switch as defined in claim 1 wherein said locking members comprise integrally formed flexible portions of said actuator.

3. The electric switch as defined in claim 2 wherein said integrally formed flexible portions comprise cantilevered sides of said actuator, distal ends of said cantilevered sides being aligned with said projections when said actuator is in said second position blocking movement of said actuator to said first position.

4. The electric switch as defined in claim 3 wherein said key portions and said cantilevered sides have cam surfaces cooperably engaged when said operator is attached to said actuator, said cam surfaces effecting deflection of said cantilevered sides inwardly.

5. The electric switch as defined in claim 4 wherein said key portions extend along said cantilevered sides adjacent said sidewalls, and said sidewalls restrain said key portions against outward camming by said cantilevered sides.

6. The electric switch as defined in claim 5 further comprising spring means biasing said distal ends of said cantilevered sides apart.

7. The electric switch as defined in claim 6 wherein said spring means comprises a helical spring disposed under compression between said cantilevered sides.

8. The electric switch as defined in claim 1 wherein said locking members comprise members formed from a spring metal clip attached to said actuator.

9. The electric switch as defined in claim 8 wherein said locking members are disposed as cantilevered sides of said actuator, distal ends of said cantilevered sides being aligned with said projections when said actuator is in said second position blocking movement of said actuator to said first postion.

10. The electric switch as defined in claim 9 wherein said key portions and said cantilevered sides have cam surfaces cooperably engaged when said operator is attached to said actuator, said cam surfaces effecting deflection of said cantilevered sides inwardly.

11. The electric switch as defined in claim 10 wherein said key portions extend along said cantilevered sides adjacent said sidewalls, and said sidewalls restrain said key portions against outward camming by said cantilevered sides.

12. The electric switch as defined in claim 11 further comprising spring means biasing said distal ends of said cantilevered sides apart.

13. The electric switch as defined in claim 12 wherein said spring means comprises a helical spring disposed under compression between said cantilevered sides.

14. The electric switch as defined in claim 1 wherein said actuator and said operator comprise cooperable detent means securing said operator to said actuator.

15. The electric switch as defined in claim 14 wherein said cooperable detent means comprises a projection having an enlarged shoulder portion on one of said actuator or said operator, and a slot having a constricted open end on another of said actuator or said operator, said enlarged shoulder portion deflecting said constricted open end to provide snap-on attachment of said operator to said actuator.

16. An electric switch comprising, in combination:

an insulating housing having an opening therein and a pair of spaced projections at opposite sidewalls within said opening;

switch contacts within said housing;

an actuator pivotally supported within said opening for movement between first and second positions for actuating said switch contacts between first and second conditions, respectively, said actuator comprising locking members at opposite sides juxtaposed said sidewalls, said members being aligned with said projections when said actuator is in said second position blocking movement of said actuator to said first position;

an operator removably attached to said actuator, said operator having depending key portions camming said locking members inwardly away from said sidewalls clear of said projections permitting unrestricted movement of said actuator between said first and second positions when said operator is attached to said actuator, wherein said actuator comprises an upstanding lever having integrally formed projections extending outward from opposite sides of said lever; and said operator comprises a hollow upstanding lever cap disposed over said lever, opposite sidewalls of said cap having apertures formed complementally to said projections, said apertures having constricted bottom openings deformable upon attachment of said operator to said actuator to provide a snap-fit therebetween.

* * * * *